US012630934B2

(12) United States Patent
Catanorchi et al.

(10) Patent No.: US 12,630,934 B2
(45) Date of Patent: May 19, 2026

(54) DEVICE FOR THE PRODUCTION OF HYDROGEN

(71) Applicant: Enapter S.r.l., Crespina Lorenzana (IT)

(72) Inventors: Stefano Catanorchi, Crespina Lorenzana (IT); Antonio Filpi, Crespina Lorenzana (IT); Federica Trivarelli, Crespina Lorenzana (IT); Jan-Justus Schmidt, Crespina Lorenzana (IT); Sean Crawford Chapman, Crespina Lorenzana (IT)

(73) Assignee: Enapter S.r.l., Crespina (IT)

( * ) Notice: Subject to any disclaimer, the term of this patent is extended or adjusted under 35 U.S.C. 154(b) by 430 days.

(21) Appl. No.: 17/621,678

(22) PCT Filed: Jun. 24, 2020

(86) PCT No.: PCT/EP2020/067658
§ 371 (c)(1),
(2) Date: Dec. 21, 2021

(87) PCT Pub. No.: WO2020/260370
PCT Pub. Date: Dec. 30, 2020

(65) Prior Publication Data

US 2022/0341046 A1 Oct. 27, 2022

(30) Foreign Application Priority Data

Jun. 27, 2019 (GB) ..... 1909232

(51) Int. Cl.
*C25B 9/23* (2021.01)
*C25B 1/04* (2021.01)
(Continued)

(52) U.S. Cl.
CPC ..... *C25B 9/23* (2021.01); *C25B 1/04* (2013.01); *C25B 11/052* (2021.01);
(Continued)

(58) Field of Classification Search
CPC ..... C25B 1/04; C25B 9/23; C25B 11/052; C25B 11/056; C25B 11/061; C25B 11/065; C25B 11/081; C25B 13/08; C25B 15/08
See application file for complete search history.

(56) References Cited

U.S. PATENT DOCUMENTS 5,853,798 A 12/1998 Dube
2011/0048962 A1* 3/2011 Reece ..... H01M 4/90 205/639
(Continued)

FOREIGN PATENT DOCUMENTS

JP S59202227 A 11/1984
KR 20150104474 A 9/2015
(Continued)

OTHER PUBLICATIONS

Vincent, I., et al., Low cost hydrogen production by anion exchange membrane electrolysis: A review, Renewable and Sustainable Energy Reviews, Jan. 2018, vol. 81, part 2, pp. 1690-1704.
(Continued)

*Primary Examiner* — Ciel P Contreras
(74) *Attorney, Agent, or Firm* — Hodgson Russ LLP

(57) ABSTRACT

This invention relates to a device for the electrolytic production of hydrogen and oxygen from a water-containing liquid, the device comprising: an anodic half-cell (3) and a cathodic half-cell (4), with an anion exchange membrane (9) situated between the two half-cells. The electrodes (7, 8) of the half-cells (3, 4) and the anion exchange membrane (9) form a membrane/electrode assembly (MEA). There is also provided means (2) for feeding the water-containing liquid to only one of the anodic half-cell (3) and the cathodic half-cell (4), wherein the electrode in the other, substantially dry, half-cell is ionomer-free and/or binder-free.

15 Claims, 1 Drawing Sheet

(51) Int. Cl.

| | |
|---|---|
| ***C25B 11/052*** | (2021.01) |
| ***C25B 11/056*** | (2021.01) |
| ***C25B 11/061*** | (2021.01) |
| ***C25B 11/065*** | (2021.01) |
| ***C25B 11/081*** | (2021.01) |
| ***C25B 13/08*** | (2006.01) |
| ***C25B 15/08*** | (2006.01) |

(52) U.S. Cl.
CPC ..... *C25B 11/056* (2021.01); *C25B 11/061* (2021.01); *C25B 11/065* (2021.01); *C25B 11/081* (2021.01); *C25B 13/08* (2013.01); *C25B 15/08* (2013.01)

(56) References Cited

U.S. PATENT DOCUMENTS

| | | | | |
|---|---|---|---|---|
| 2013/0118912 | A1 | 5/2013 | Reece et al. | |
| 2013/0292252 | A1 | 11/2013 | Linder et al. | |
| 2015/0259810 | A1 | 9/2015 | Lewis et al. | |
| 2016/0251766 | A1 | 9/2016 | Masel et al. | |
| 2016/0355936 | A1* | 12/2016 | Dismukes | C25B 11/075 |
| 2017/0174800 | A1 | 6/2017 | Isomura et al. | |
| 2017/0218525 | A1 | 8/2017 | Swaminathan et al. | |
| 2018/0202054 | A1* | 7/2018 | Bahar | B01D 53/326 |
| 2019/0226102 | A1* | 7/2019 | Mitsushima | C25B 9/00 |
| 2019/0264341 | A1* | 8/2019 | Bahar | C25B 9/73 |

FOREIGN PATENT DOCUMENTS

| | | | |
|---|---|---|---|
| WO | 2009007922 | A2 | 1/2009 |
| WO | 2009/093042 | A1 | 7/2009 |
| WO | 2011/004343 | A1 | 1/2011 |
| WO | 2017022755 | A1 | 2/2017 |
| WO | 2017/176598 | A1 | 10/2017 |
| WO | 2018026743 | A1 | 2/2018 |

OTHER PUBLICATIONS

Zhu Jianguang, et al., Organic Chemistry, Sep. 1979, pp. 186-187, Metallurgical Industry Press, China.

* cited by examiner

DEVICE FOR THE PRODUCTION OF HYDROGEN

The present invention relates to a device for the production of hydrogen, particularly but not necessarily limited to, electrolysers. utilising renewable energy sources.

Hydrogen has a multitude of applications, ranging from energy storage to the production of fertilisers. Hydrogen can be derived from many sources. Some of these sources, such as fossil fuels, are undesirable for obvious reasons. Therefore, there is a need to be able to produce hydrogen in a reliable and sustainable manner.

Electrolysers are devices used for the generation of hydrogen and oxygen by splitting water. It is possible to power such devices with excess renewable energy, using hydrogen as a means for energy storage as opposed to batteries, for example. Electrolysers generally fall in one of three main technologies currently available, namely anion exchange membrane (AEM), proton exchange membrane (PEM), and liquid alkaline systems. Liquid alkaline systems are the most established technology, with PEM being somewhat established. AEM electrolysers are a relatively new technology. Other technologies, such as solid oxide electrolysis are available.

AEM and PEM electrolysers are reliant on the transfer of ions from one half-cell to the other for the generation of hydrogen. AEM systems rely on the movement of hydroxide ions, $OH^-$, whilst PEM systems rely on the movement of hydrogen ions, $H^+$.

The half-reactions in an AEM electrolyser are as follows:

$$\text{Anode—}4OH^- \rightarrow 2H_2O + 4e^- + O_2$$

$$\text{Cathode—}4H_2O + 4e^- \rightarrow 2H_2 + 4OH^-$$

The membranes for AEM and PEM systems comprise cations and anions respectively to facilitate the movement of either $OH^-$ or $H^+$. Generally, the membrane electrode assembly (MEA) comprises ionomer and/or binder to improve the properties of the assembly such as conductivity, mechanical strength and thermal stability. The addition of binders serves to maintain the integrity of the electrode assembly, whereas ionomers help to increase, in the absence of a liquid electrolyte, available catalyst layer thickness working as a solid electrolyte and helping to create triple phase boundary sites by forming agglomerates of substrate, the ionomer and electrocatalyst. Additions of ionomer and/or binder add costs, and may be linked to reduced performance, for example-ionomers may decrease durability in some instances, whilst binders impact the conductivity.

The object of the present invention is to provide an improved device for the production of hydrogen.

According to the invention there is provided a device for the electrolytic production of hydrogen and oxygen from a water-containing liquid, the device comprising:

- an anodic half-cell which includes an anodic electrode, and
- a cathodic half-cell which includes a cathodic electrode,
- an anion exchange membrane (AEM) situated between the two half-cells, wherein:
  - the anodic electrode, the cathodic electrode and the anion exchange membrane form an MEA,
  - means for feeding the water-containing liquid to only one of the anodic half-cell and the cathodic half-cell are provided, wherein:
    - at least the electrode in the other, substantially dry, half-cell is ionomer-free and/or binder-free.

As used herein, the water-containing liquid can be any solution containing water molecules. As it is an AEM system, the solution will normally be at least slightly alkaline, more preferably mild to strong alkaline. It is envisaged that alkalinity may be achieved by any suitable compound (e.g. strong bases, buffer solutions . . . ). However, in the preferred embodiment KOH is used. The water-containing liquid may also comprise tap water, sea water, more preferably distilled water or deionized water.

A benefit of an AEM electrolyser is the ability to use less caustic electrolyte. It is envisaged that the presence of KOH, or suitable alternative, is in the range of 1%-30%, more preferably still between 0.1% and 10%. More preferably, the KOH is approximately 0.1% to 5%, and most preferably between 0.2% and 2%. Whilst KOH is preferred due to its solubility and the solubility of its carbonate leading to reduced issues related to precipitation, alternatives include NaOH and LiOH.

As used herein, reference to a "dry" half-cell or substantially dry half-cell, is in reference to the half-cell to which no liquid is directly introduced. This is displayed clearly in the accompanying figures. With a dry cathode it is acknowledged that osmotic drag may result in the temporary presence of some water in the dry half-cell but, any water present in the dry half-cell is readily split into hydrogen and hydroxyl ions, as demonstrated in the reactions taking place. The hydroxyl ions migrate back to the anode, simultaneously bringing solvated water by electroosmotic drag.

With a dry anode which it is acknowledged that electroosmotic drag may move hydroxyl ions in the dry half-cell producing oxygen and water. The water formed migrates back to the cathode by osmotic drag. In both cases the temporary presence of water is not considered sufficient to render the half-cell not dry.

The individual of ordinary skill in the art will be familiar with the balance of plant (BOP), so, the BOP is not discussed in any depth herein.

In the preferred embodiment, the pH of the water containing liquid is 7, or greater than 7. Normally, the pH is in the range of 12-14. Preferably, the pH range is between 12.5 and 13.5, in particular the pH is between 13 and 13.5, for example the pH may be 13.25. Alternatively, it is envisaged as possible and preferred that the system may use a liquid which is substantially neutral with a pH of 7.

Whilst it is possible to operate an electrolyser in accordance with the present invention at a wide range of temperatures, it is envisaged that the temperature is in the range of 40° C. to 80° C. More preferably in the range of 50° C. to 70° C. and more preferably still at substantially 55° C. to 60° C.

It is preferred that the electrolyser is powered by renewable energy, including but not limited to solar, wind, hydro, geothermal or a combination thereof. That said, mains electricity may be used to power the electrolyser. Whether due to fluctuations in the price of mains power, or renewables providing an excess beyond the current load of the electrolyser user, the electrolyser is such that it is adapted for intermittent operation.

Binders are used to improve the mechanical stability of the MEA, amongst other things. On the other hand, an absence of binders means that the stability of the catalytic layer has to be ensured, preventing delamination from the membrane and ensuring intimate contact between the catalyst and membrane. It is envisaged that a variety of manufacturing methods may be employed to achieve this, including but not limited to: crosslinking of the polymeric backbone of the membrane, usage of a thicker membrane, improving the intermolecular binding forces between the polymer and the catalyst, or a combination thereof. However, such measures may reduce the conductivity of the MEA which may impact efficiency.

Preferably, the water-containing liquid is fed to the anode such that the cathode is dry and the produced hydrogen substantially dry and electrolyte free. Alternatively, it is envisaged that the water-containing liquid may be fed to the cathode side of the cell such that the anode is dry and the produced oxygen substantially dry and the anodic half-cell electrolyte free.

Hydrogen is often required at elevated pressures. Accordingly, it is envisaged that the device for the production of hydrogen may comprise means for allowing the generation of hydrogen at various elevated output pressures. Whilst hydrogen output could be at 1 bar, preferably the hydrogen will be produced above 1 bar, such as in the range of 5-50 bar, more preferably 30-40 bar and normally at 35 bar unless local legislation provides other requirements, for example 8 bar in Japan. For use in vehicles or other application, higher pressures exceeding 700 bar may be required. A compressor or other means for increasing the pressure would be required in such instances.

It is envisaged that the pre-determined output pressure of the hydrogen could be managed in a multitude of ways. The electrolyser will have a varied rate of production of hydrogen, but a constant pressure output is desirable for obvious reasons, regardless at the capacity at which the electrolyser is running. A pressure-control valve, or equivalent means, may be adjustable during use, or when the electrolyser is not operating. Indeed, it is envisaged a limit on the output pressure may be provided to conform with restrictions on production of the relevant jurisdictions, or such that it is fixed to ensure conformity with maximum pressures in the jurisdiction serviced. The BOP is not described herein.

Whilst the electrolyser may work with a single cell comprising an MEA, it is envisaged that a plurality of cells will be employed. Normally there will be between 10 and 30 cells; in the preferred embodiment there are 23 cells in a cabinet of width 48 cm (19 inches), so each cell is of width about 2 cm. that said, a stack would constitute two or more cells assembled together.

It is envisaged that the both the anodic and cathodic electrodes may be manufactured by a variety of processes such as, but not limited to, a catalyst coated membrane (CCM), catalyst coated substrate (CCS) or direct deposition (DD). For any of the above, it is possible to have at least one ionomer and/or binder free half-cell.

To render the hydrogen suitable for use in high-grade applications, it may be required to provide a dryer for the hydrogen produced by the electrolyser prior to compression, storage or other use. Any suitable means for drying may be used.

In order to remove the need for ionomers and/or binders, it is envisaged that the catalyst will be included by either DD, or a CCM. It is envisaged that a catalyst coated substrate, such as but not limited to a carbon-based cloth, paper, or felt, stainless steel foam or nickel-based foam, may be used. Preferably there is carbon cloth or paper on the cathode, and nickel foam or felt on the anode. The substrate may also act as the gas diffusion layer allowing the generated gases, hydrogen and oxygen in the cathode and anode respectively, to effuse. In such embodiments, the substrate should be porous enough to allow the required diffusion of the water containing liquid and the compounds within the hydrogen and oxygen evolution half reactions.

It is envisaged that the electrolyser will be adapted to be monitored and/or controlled by an energy monitoring system, such as software, reducing the requirement for user intervention. The monitoring system is intended to allow for the remote monitoring and control of the electrolyser operating parameters.

A benefit of AEM is the ability to use catalysts without platinum group metals (PGM). It is preferred not to use PGM or other rare earth metals as catalysts. PGM are inherently less sustainable and more costly than more abundant alternatives, such as transition group metals.

At the anode it is envisaged that non-stoichiometric transition metals oxides will be a suitable catalyst. An example catalyst at the anode includes $CuCoO_x$.

Example catalyst at the cathode, for hydrogen evolution reaction, includes $Ni/CeO_2$-$La_2O_3/C$. Other suitable non-PGM cathode catalysts may be used including chalcogenides and pnictogenides such as transition metal sulphides, transition metal phosphides or transition metals dispersed in an electrically conductive substrate, such as nitrogen doped carbon or carbon adapted to have a large surface area, or other non-stoichiometric transition metal oxides, having spinel or perovskitic structures or transition metal complexes.

The required properties for any membrane to be used are mechanical strength, thermal stability, chemical stability, ionic conductivity and preventing both electrons and the gases generated from crossing between the half-cell compartments.

Preferably, the AEM is formed of a polymer backbone coupled with a functional group suitable for transporting anions, namely hydroxide ions. Polymers include, but are not limited to polystyrene, polysulfone, polybenzimidazole, polyphenylene oxide, styrene-butadiene block copolymer, polyethylene and more. Crosslinking in the polymer backbone offers mechanical stability. Functional groups are discussed further below. They can be directly attached to the polymer backbone or separated by a short aliphatic or aromatic chain as a spacer in order to promote better phase separation between ion-conductive and backbone domains. Crosslinking in both polymer backbone, spacer or ion exchange groups offers higher mechanical stability and can contribute to higher chemical and thermal stability as well.

In order to facilitate the transfer of ions, an ion exchange group must be present. Suitable ions include, but are not limited ammonium, sulfonium or phosphonium salts. The strength and thermal stability of the membrane may be attributed to the polymeric backbone whilst the functional group allow for ionic conductivity. For the purpose of this invention, the membrane is conductive to anions.

To help understanding of the invention, a specific embodiment thereof will now be described by way of example and with reference to the accompanying drawings, in which.

Figure 1A:
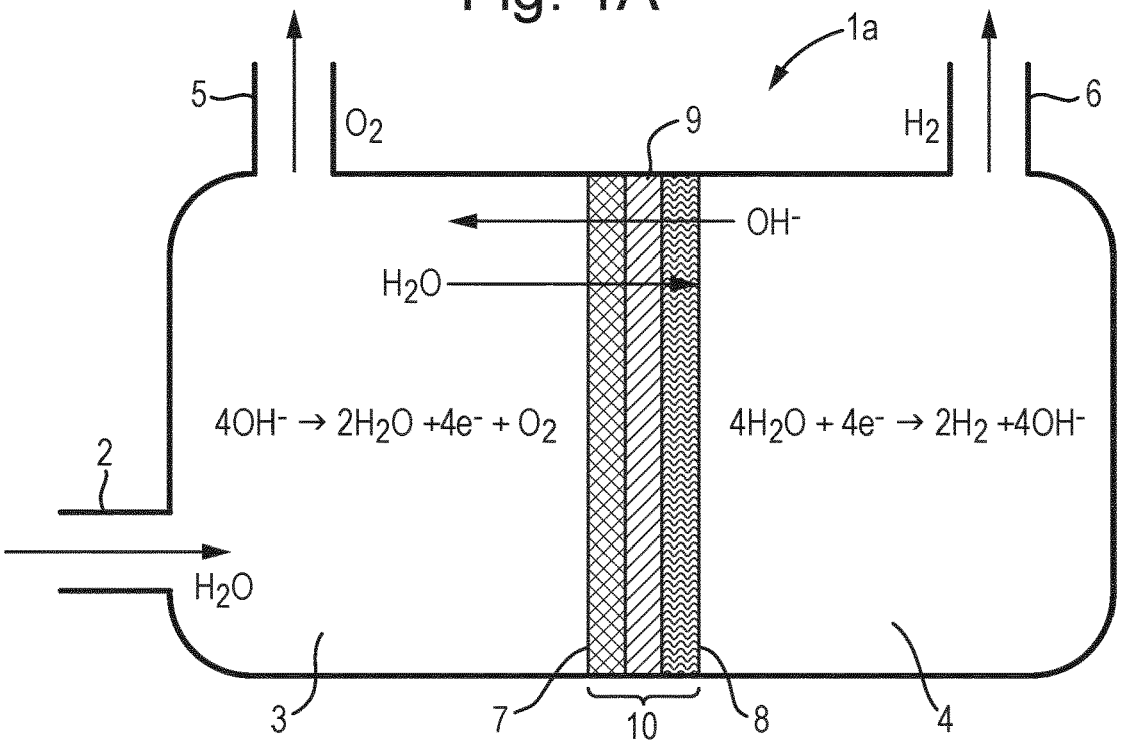
FIG. 1A shows an AEM system with a dry cathode.
Figure 1B:
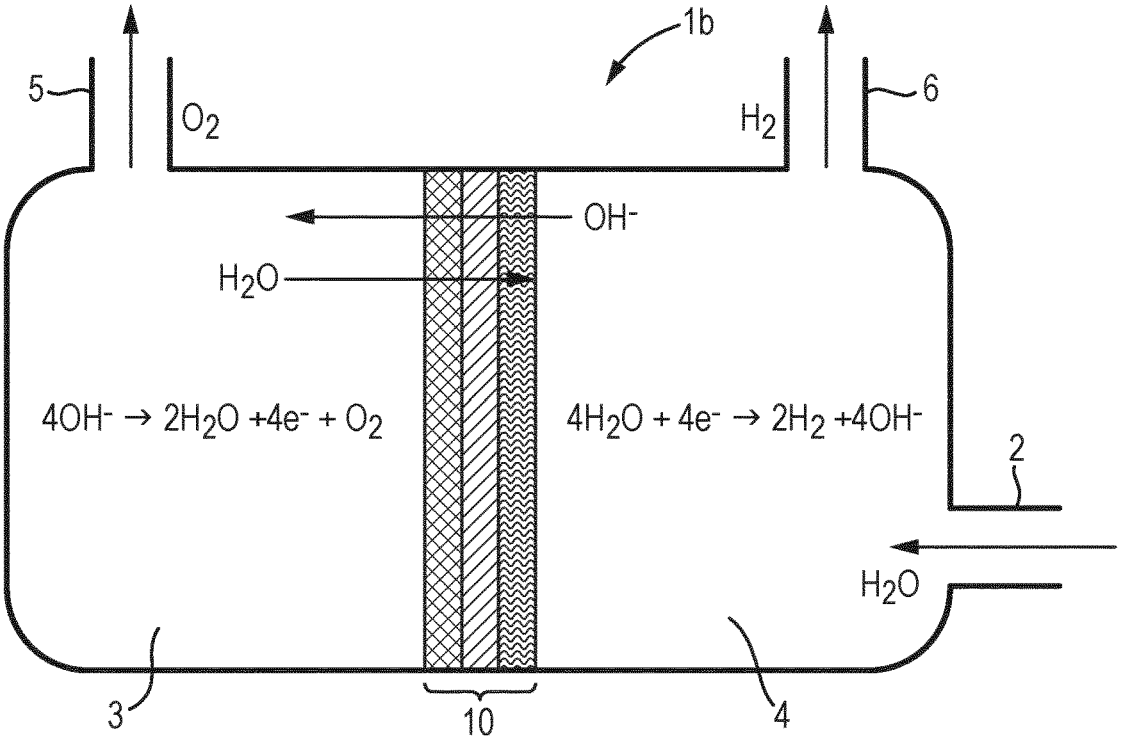
FIG. 1B shows an AEM system with a dry anode.

FIG. 1A and FIG. 1B pertain to embodiments of the invention utilising AEM. FIG. 1A shows an embodiment of the present invention wherein the substantially aqueous solution is introduced on the anode side. Typical operation of this embodiment is described herein.

In FIG. 1A an electrolyser cell 1*a* can be seen, the cell comprising an anodic half-cell 3 and a cathodic half-cell 4 as well as an MEA 10. There is an inlet 2 for introducing an aqueous solution to the anodic half-cell. This may be a dilute aqueous solution of KOH, but it is envisaged that alternative alkaline salts can be used, or, potentially, pure water. The means for supplying power to the cell are well known, and as such are not shown; this is the case for all embodiments.

The MEA 10 comprises the anodic electrode (or anode) 7, the cathodic electrode (or cathode) 8 and the anion exchange membrane 9. In this embodiment of the invention, as the inlet 2 is to the compartment containing the anodic half-cell 3, it is the cathode 8 which is ionomer and/or binder free.

The oxygen generated on the anode side of the cell leaves the cell by outlet 5. Whilst the oxygen may be processed for use elsewhere, normally it is vented. The hydrogen produced at the cathode leaves the cell via outlet 6. The hydrogen stream may comprise trace amounts of water as a result of osmotic drag, so this stream may be passed through a drier prior to compression for storage. In the embodiment with a dry cathode, altering the current density will impact the purity of the hydrogen produced. Increasing the current density increases the rate of hydrogen production, meaning less water is present at the cathode. Water is further removed from the cathode due to the migration of hydroxyl ions back to the anode, simultaneously bringing solvated water by electroosmotic drag.

The reaction in each half-cell is as follows:

$$\text{Anode:}4OH^- \rightarrow 2H_2O + 4e^- + O_2$$

$$\text{Cathode:}4H_2O + 4e^- \rightarrow 2H_2 + 4OH^-$$

The hydrogen produced is substantially dry due to the fact that there is no electrolyte/water on the cathode side. It is acknowledged that some water may cross the membrane due to osmotic drag, however this is understood to be minimal, and is not considered to render the cathode not dry.

Now referring to FIG. 1B, it can be seen that the embodiment of FIG. 1B largely resembles that of FIG. 1A. The difference is that the inlet 2 is to the compartment containing the cathodic half-cell 4 as opposed to the anodic half-cell 3. The reaction in each half-cell is the same as above. It can be seen that water is consumed at the cathode 8, so this embodiment is therefore not limited by the movement of water from the anode 7 to the cathode 8. However, this mode of operation results in moist hydrogen being generated whereas dry hydrogen is generally preferred. As such, a drier (not shown) would be used to purify the hydrogen. Such a stage would normally be done before compression of the produced hydrogen (not shown).

In FIG. 1A, as the cathode 8 is dry and at least the cathode 8 is ionomer and/or binder free. In FIG. 1B as the anode 7 is dry at least the anode 7 is ionomer and/or binder free.

In the preferred embodiment, both the anode and cathode are ionomer and/or binder free. This meaning that there is no ionomer in the anode, or cathode and/or there is no binder in the anode, or cathode, or a combination thereof.

The present invention is not intended to be limited to any particular membrane beyond being an AEM. Any membrane exhibiting the required characteristics may be used, that being one which allows for the transport of ions from one half-cell to the other.

Furthermore, both the functionalised group and the polymeric backbone are not intended to be limited to any named example, and any suitable polymer backbone comprising any ion exchange group may be used, or any inorganic or organic fillers or acting as a reinforcement to be added to its composition.

The present invention is not intended to be limited to the catalysts used. Any suitable catalyst or membrane may be used as long as the appropriate characteristics are displayed.

Additionally, the construction and or composition of the MEA may be varied to enable the utilisation of de-ionised water or another solution with a substantially neutral pH. Buffer solutions may also be used. In either case, the adaptations are not intended to extend beyond the scope of the invention.

The invention claimed is:

1. A device for the electrolytic production of hydrogen and oxygen from a water-containing liquid, the device comprising:
- an anodic half-cell which includes an anodic electrode, and
- a cathodic half-cell which includes a cathodic electrode,
- an anion exchange membrane (AEM) situated between the two half-cells, wherein:
  - the anodic electrode, the cathodic electrode, and the anion exchange membrane form an MEA,
  - an inlet configured to introduce a water-containing liquid to only the anodic half-cell is provided, wherein:
- the cathodic electrode is ionomer-free and/or binder-free and the cathodic half-cell is substantially dry, and
- the anion exchange membrane comprises a crosslinked polymeric backbone.

2. A device as claimed in claim 1 wherein during use the water-containing liquid has a pH of 7 or higher.

3. A device as claimed in claim 1 wherein during use the water-containing liquid has a pH between 12 and 14.

4. A device as claimed in claim 1 wherein the water containing liquid also comprises between 0.1% and 10% KOH.

5. A device as claimed in claim 1 wherein the temperature of the system is in the range of 40° C. to 80° C.

6. A device as claimed in claim 1 wherein the electrodes are connected to a power supply which is a source of renewable energy.

7. A device as claimed in claim 1 wherein the device is adapted to produce hydrogen at elevated pressures above 1 bar.

8. A device as claimed in claim 1 wherein any of the anodic, or cathodic electrodes is:
- A catalyst coated membrane,
- A catalyst coated substrate, or
- A direct membrane deposition.

9. A device as claimed in claim 8 wherein the catalyst coated substrate may be any one of:
- Carbon based cloth
- Carbon based paper
- Carbon based felt
- Stainless steel foam, and
- Nickel based foam.

10. A device as claimed in claim 1 wherein at least one catalyst is made of platinum group free metals.

11. A device as claimed in claim 1 wherein a catalyst at the anodic electrode, for oxygen evolution reaction, includes non-stoichiometric transition metal oxides.

12. A device as claimed in claim 1 wherein a catalyst at the cathodic electrode, for hydrogen evolution reaction, includes: chalcogenides, pnictogenides, transition metal sulphides, transition metal phosphides, transition metals dispersed in an electrically conductive substrate, or other non-stoichiometric transition metal oxides having spinel or perovskitic structures or transition metal complexes.

13. A device as claimed in claim 1 wherein the AEM is formed of a polymer backbone coupled with a functional group suitable for transporting anions, the polymer being any one of: polystyrene, polysulfone, polybenzimidazole, polyphenylene oxide, styrene-butadiene block copolymer, polyethylene.

14. A device as claimed in claim 13 wherein there is a spacer between the polymer backbone and the functional group.

15. A device as claimed in claim 13 wherein the functional group can be any one or more of: ammonium, sulfonium or phosphonium salts.

* * * * *